United States Patent [19]

Willem

[11] 4,280,017

[45] Jul. 21, 1981

[54] MULTIPLE-DIELECTRIC INSULATOR

[75] Inventor: Michel Willem, Abrest, France

[73] Assignee: Societe Anonyme dite: Ceraver, Paris, France

[21] Appl. No.: 101,007

[22] Filed: Dec. 6, 1979

[30] Foreign Application Priority Data

Dec. 21, 1978 [FR] France ..... 78 35918

[51] Int. Cl.[3] ..... H01B 17/02; H01B 17/08

[52] U.S. Cl. ..... 174/182; 174/150

[58] Field of Search ..... 174/139, 141 R, 141 C, 174/150, 182, 188, 189, 194, 195, 196, 210, 212

[56] References Cited

U.S. PATENT DOCUMENTS 2,099,540 11/1937 Smith ..... 174/139

FOREIGN PATENT DOCUMENTS 533069 11/1921 France ..... 174/140 R 1166372 6/1958 France ..... 174/150

OTHER PUBLICATIONS

*Lapp Insulators for 1928–Catalogue No. 4*, published by Lapp Insulator Co., Inc., LeRoy, New York, copyright 1928, p. 76 relied on.

*Primary Examiner*—Laramie E. Askin

*Attorney, Agent, or Firm*—Kenyon & Kenyon

[57] ABSTRACT

An insulator which includes at least one plate-shaped dielectric component 3 having a cylindrical head 4, at least one connecting member 14 having at least one pin end 5 embedded inside a recess defined within the head of a dielectric component and at least one other connecting member having a cap 12 which covers the head of the dielectric and is sealed thereon, the one connecting member having a flange (15, 27, 28, 29) spaced from the embedded pin end and whose outer diameter is larger than the outer diameter of the head in which said end is embedded and the cap of the other connecting member having a flared base (16, 30, 31, 32) which covers an annular portion of the dielectric which extends beyond the outer diameter of the head, so as to define a rigid extension on either side of the dielectric component.

The invention applies in particular to multiple-dielectric insulators in which the dielectric components are made of tempered glass.

1 Claim, 2 Drawing Figures

MULTIPLE-DIELECTRIC INSULATOR

Figure 1:
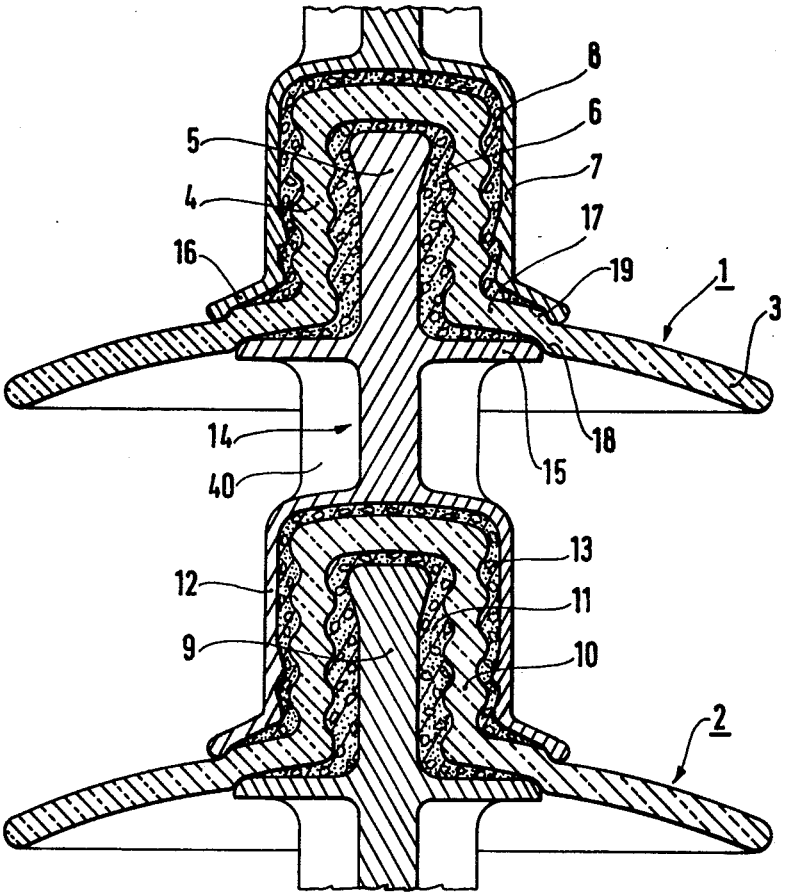

The present invention relates to an insulator of the type which includes at least one plate-shaped dielectric component having a cylindrical head, at least one pin having at least one end embedded inside a recess defined within the head of a dielectric component, and at least one cap which covers the head of a dielectric component and is sealed thereon.

Generally, such insulators include a plurality of such components which form a multiple-dielectric chain arranged head-to-tail, in which the first cap has a fixing member for fixing it to a support and the last pin is extended by a member which allows it to support an electric cable. In the intermediate components, a cap and a pin are formed at opposite ends of a single part which includes a first portion which is a pin for one dielectric, and a second portion which is a cap for the following dielectric.

In the case of an insulator which is disposed horizontally, the disposition is slightly different; the dielectrics are set alternately head-to-head and tail-to-tail, and twin pins and twin caps are therefore formed, but the invention applies to both cases.

In such insulators, the dielectrics are often made of tempered glass and in the case, e.g. of shattering of a dielectric, as occurs when the dielectric of an insulator is hit by a bullet, only glass debris of the head of the dielectric remain which form the end of the head and the cylindrical zone between the cap and the pin.

It has been proposed (e.g., in U.S. Pat. No. 2,099,540 of D. H. Smith) to install a protective shield formed by two corrugated metal half-shells to protect insulators at the tops of telegraph poles, but such a shield, purposely installed loose to allow movement resulting from shocks, actually constitutes only a protective shield, without reinforcing the insulators in any way.

There is therefore always a risk of the insulator falling with the cable which is fixed thereto. This is undesirable.

The present invention aims to mitigate these disadvantages. It provides an insulator which includes at least one plate-shaped dielectric component having a cylindrical head, at least one connecting member having at least one pin end embedded inside a recess defined within the head of a dielectric component, and at least one other connecting member having at least one cap end which covers the head of a dielectric and is sealed thereon, wherein each pin end has a flange spaced from its embedded end, the flange having an outside diameter larger than the outside diameter of the head in which said end is embedded, and wherein each cap end has a flared base which covers an annular portion of the dielectric which extends beyond the outside diameter of the head, so as to define a rigid extension on either side of the dielectric component.

According to a preferred embodiment of the invention, the annular portion of the dielectric lying between the flange of the pin end of the one connecting member and the base of the cap end of the other connecting member has a circular boss on the cap end, said boss being covered by the flared base of the cap, and a circular reinforcement on the flange end contiguously surrounding the flange.

Figure 2:
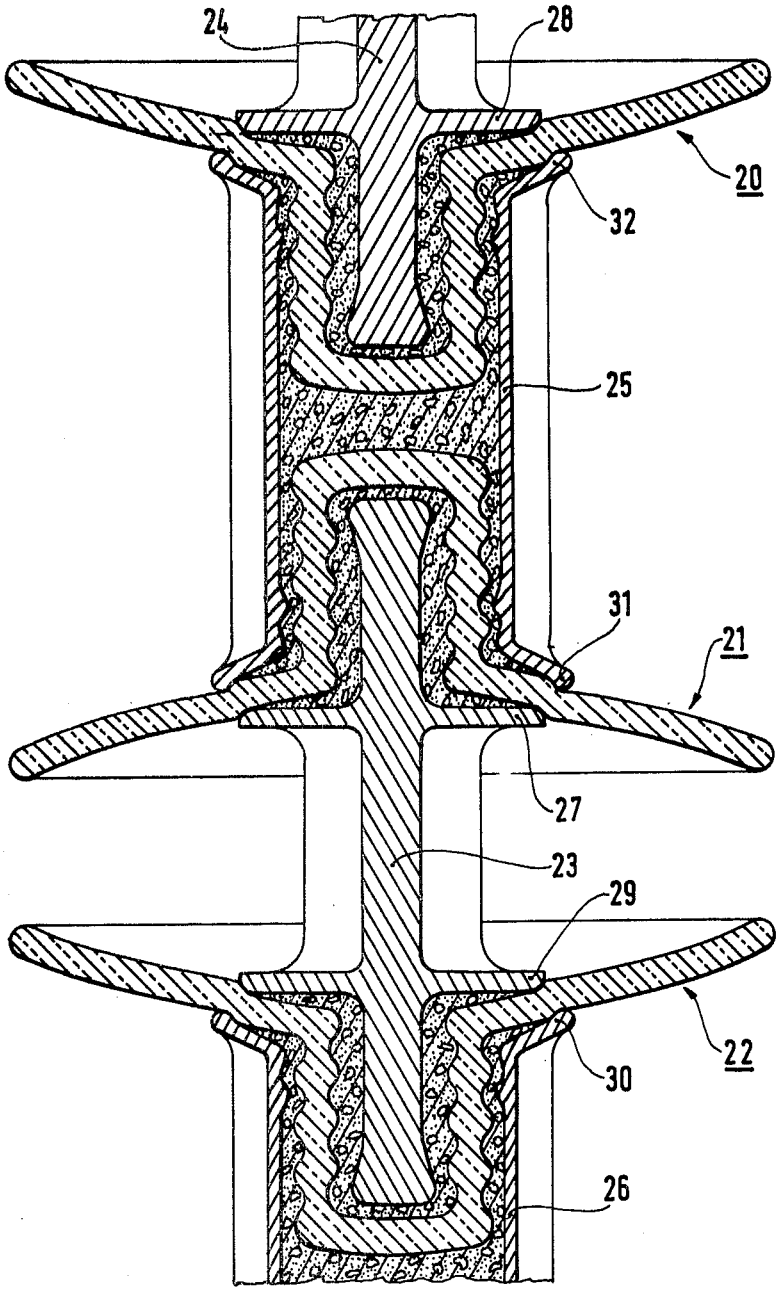

Therefore, in accordance with the invention, in the event that a dielectric is shattered, pieces of broken glass are trapped firstly between the pin and the cap and also between the flange and the base of the cap. This prevents the broken glass from being dislodged and provides cohesion between the remaining pieces in such a way that the insulator retains a much greater proportion of its mechanical strength. Embodiments of the invention will be described hereinbelow with reference to the accompanying drawings, in which:

FIG. 1 is a partial cross-section of an insulator in accordance with the invention; and FIG. 2 is a partial cross-section of an insulator in accordance with the invention in the case of head-to-head and tail-to-tail disposition of the dielectrics. FIG. 1 shows generally a partial view of an insulator which includes two dielectrics 1 and 2. The dielectric 1 includes conventionally a substantially plate-shaped portion 3 which has a cylindrical head 4. The dielectric 1 is usually made of tempered glass.

One end of a metal pin 5 is embedded in the recess defined by the head portion 4 of the dielectric 1 by a mass of cement mortar 6. A metal cap 7 is also secured onto the head portion 4 of the dielectric 1 by cement mortar 8. Likewise, a metal pin 9 is embedded in a head portion 10 of the dielectric 2 by mortar 11 and a metal cap 12 is secured onto the head portion 10 of the dielectric 2 by mortar 13.

As illustrated, the assembly has a chain type configuration and is here linked by a pin-and-cap unit 14 whose pin portion 5 is connected to the dielectric 1 while the cap 12 of the pin-and-cap unit 14 is connected to the dielectric 2.

In accordance with the invention, just below the plate-shaped portion of the dielectric 1, the pin portion 5 has a flange 15 having a diameter greater than the diameter of the head portion 4 of the dielectric 1, and the cap 7 has a flared base 16 which covers part of the inverted plate-shaped portion 3 of the dielectric 1 in such a way that a substantially horizontal zone 17 of the dielectric 1 is thus trapped between the flange 15 and the flared base 16 of the cap 7.

Therefore, in the event the glass of the dielectric breaks, the fragments in the zone 17 remain trapped and help to resist bending of the assembly.

In order to improve the grip, the inverted plate portion 3 has a reinforcement 18 and a boss 19 which give it a staircase profile. The base 16 of the cap 7 extends to cover the boss 19. Likewise, the flange 15 extends up to the strengthening portion 18. The pin-and-cap unit 14 includes strengthening fins 40 which link the flange 15 to the cap 12.

FIG. 2 illustrates part of an insulator intended to be placed horizontally.

The dielectrics 20, 21, 22 are disposed head-to-head and tail-to-tail. The assembly is then formed by means of twin pins 23, 24 and twin caps 25, 26. The pins also have flanges 27, 28, 29 and the caps have bases 30, 31, 32.

In FIG. 2, the pins and the caps are embedded but twin pins and twin caps can be gravity cast on a crimped sleeve as described in French Pat. Publication No. 2 209 987.

I claim:

1. An insulator which includes at least one plate-shaped dielectric component having a cylindrical head, a connecting member having at least one pin end, each pin end being embedded inside a recess defined within the head of a corresponding one of the dielectric components, and another connecting member having at least one cap end, each cap end covering the head of a corresponding one of the dielectric components and being sealed thereon, each connecting member having a pin end also having a flange spaced from the embedded pin end, the flange having an outside diameter larger than the outside diameter of the head of the dielectric component in which said pin end is embedded, and each cap has a flared base which covers an annular portion of the plate-shaped part of the dielectric component which extends beyond the outside diameter of the head, so as to define a rigid extension on either side of the dielectric component, wherein the improvement comprises:

said dielectric component is made of tempered glass, and the plate-shaped part of the dielectric component has an annular step which forms a raised circular boss on the head end side of the plate-shaped part and a circular depression on the other side of the plate-shaped part, the outer perimeter of said boss being covered by the flared base of the cap end, and the flange of the pin end contiguously abutting the outer perimeter of said depression, whereby in the event that the dielectric component is shattered, substantially all of the pieces forming the head and that portion of the plate-shaped part within the annular step will be trapped between the flanged pin end of the one connecting member and the flared cap end of the other connecting member to maintain resistance of the insulator to bending.

* * * * *